United States Patent [19]

Koza et al.

[11] Patent Number: 5,069,453

[45] Date of Patent: Dec. 3, 1991

[54] TICKET APPARATUS WITH A TRANSMITTER

[75] Inventors: John R. Koza, Los Altos Hils; John R. Ferguson, Greenbrae; Maximiano D. Torneros, Fremont, all of Calif.

[73] Assignee: John R. Koza, Los Altos Hills, Calif.

[21] Appl. No.: 535,749

[22] Filed: Jun. 8, 1990

Related U.S. Application Data

[63] Continuation-in-part of Ser. No. 461,418, Jan. 5, 1990.

[51] Int. Cl.[5] ..... A63F 9/24; A63F 3/06

[52] U.S. Cl. ..... 273/139; 273/138 A; 273/439; 273/269; 235/380

[58] Field of Search ..... 273/1 E, 138 A, 138 R, 273/148 R, 269, 139, 439; 235/380, 381; 364/410, 412; 902/23; 340/323 R; 455/89, 11; 370/94.1, 85

[56] References Cited

U.S. PATENT DOCUMENTS

| | | | |
|---|---|---|---|
| 3,259,389 | 7/1966 | Blondell | 273/138 |
| 3,466,775 | 9/1969 | Smith | 40/52 |
| 4,001,828 | 1/1977 | Culpepper | 343/113 R |
| 4,021,807 | 5/1977 | Culpepper et al. | 343/112 R |
| 4,023,176 | 5/1977 | Currie et al. | 343/113 R |
| 4,206,920 | 6/1980 | Weatherford et al. | 273/138 |
| 4,254,404 | 3/1981 | White | 273/138 A |
| 4,323,770 | 4/1982 | Pieulot et al. | 273/138 A |
| 4,373,726 | 2/1983 | Churchill et al. | 273/138 |
| 4,540,174 | 9/1985 | Coppock | 273/138 |
| 4,592,546 | 6/1986 | Frascenda et al. | 273/1 E |
| 4,624,462 | 7/1986 | Itkis | 273/269 |
| 4,639,225 | 1/1987 | Washizuka | 434/308 |
| 4,696,054 | 9/1987 | Tsugei et al. | 455/89 |
| 4,764,666 | 8/1988 | Bergeron | 235/380 |
| 4,792,968 | 12/1988 | Katz | 379/92 |
| 4,803,487 | 2/1989 | Willard et al. | 340/825 |
| 4,822,990 | 4/1989 | Tamada et al. | 235/380 |
| 4,882,473 | 11/1989 | Bergeron et al. | 235/380 |
| 4,941,143 | 7/1990 | Twitty etal. | 370/85.2 |

OTHER PUBLICATIONS

B. Sherwin, *Fans Must Call Right Plays in TV-Football Game*, Seattle Times (Oct. 11, 1987).

R. Lyke, *Bars, Lounges Score Big with Sports/Trivia Video Game*, Hotel & Motel Management (Jun. 13, 1988).

J. Takiff, *Talking Back to Your TV*, The Philadelphia Daily News (Nov. 4, 1988).

J. Krupinski, *Calling the (Electronic) Signals*, Long Island Newsday (Jan. 1989).

*What Bar Patrons See as Trivia, Owners Discovery is a Pot of Gold*, New York Times (Jul. 9, 1989).

C. Smith, *Bar Bosses See New Trivia Game Filling More Seats*, The Vancouver Sun (Feb. 21, 1990).

A. Pollack, *New Interactive TV Threatens the Bliss of Couch Potatoes*, New York Times (Jun. 18, 1990).

K. Berry, *Hardware Makers Cash in On America's Betting Mania,*, New York Times (Sep. 16, 1990).

(List continued on next page.)

*Primary Examiner*—Edward M. Coven
*Assistant Examiner*—Jessica J. Harrison
*Attorney, Agent, or Firm*—Blakely, Sokoloff, Taylor & Zafman

[57] ABSTRACT

A ticket apparatus for a game is described. The ticket apparatus includes storage means for storing a first value. A receiver is included for receiving a broadcast of a broadcast value for the game, wherein the broadcast value is broadcast over a first transmission medium. The ticket apparatus includes means for ascertaining whether the first value is a winning value in view of the received broadcast value. A transmitter responsive to the ascertaining means is included for transmitting over a second transmission medium a signal that indicates that the first value is the winning value if the first value is the winning value. A method of playing a game is also described, wherein locater means are used to locate a ticket apparatus.

33 Claims, 8 Drawing Sheets

OTHER PUBLICATIONS

NTN TM 0 Entertainment Network Brochure, NTC Communications, Inc. (1989).

*The NTN Monitor*, vol. 2, No. 6, (Jun. 1990).

NTN Programming Listing (not dated, but prior to Jun. 22, 1990).

Rollie Fingers' Diamond Ball Notes (Not dated, but prior to Jun 22, 1990).

Data sheet for Silicon Systems SSI204 5V Low Power DTMF Receiver.

Data sheet for Motorola MC68HC805B6 8-Bit Microcontroller Unit.

Data sheet for NEC Radiopager Mark III Tone and Voice Type.

Specification for a Standard Code Format for Use in Wide Area Radio Paging Systems.

Data sheet for Siemens DL1814 Alphanumeric Intelligent Display.

TICKET APPARATUS WITH A TRANSMITTER

This patent application is a continuation-in-part of U.S. patent application Ser. No. 07/461,418, filed Jan. 5, 1990, pending.

FIELD OF THE INVENTION

The present invention relates to the field of electronic games and, more particularly, to a ticket apparatus with a transmitter for playing a game.

BACKGROUND OF THE INVENTION

Games of Chance and Skill

Various games of chance and skill are well known in the prior art. One class of these games provides for a winner (or winners) based on statistical probabilities. A set of rules is established for a given game, wherein the rules account for the probabilities of winning the given game. Many of these games are well known as casino or parlor games involving dice, playing cards, or turns of the wheel.

Games belonging to another set of known games are commonly referred to as "lottery" games or "promotional" games. In such games a number of players are each provided with a ticket. Depending on the specific type of game, the selection of the winning ticket can be achieved prior to, at the time of, or after distributing the tickets to the players. A number of the state governments in the United States conduct lotteries in which the members of the public purchase chances for winning prizes representing a portion of the total revenue from sales of such tickets.

In one popular lottery game, a person purchases a ticket for a given predetermined price, such as $1. One name given to this type of a lottery game is the "instant winner" game because the winner can be determined instantly. In this game the tickets have preprinted numbers, letters, or symbols. The numbers, letters, or symbols are typically covered by a removable opaque rub-off material or, in some cases, by a removable opaque paper flap. A certain combination provides a winning ticket. The winner's share can be fixed or variable, or, alternatively, the winner can be provided with a further opportunity to win. The number and total amount of winnings, actual or potential, is controlled by designating the number of winning tickets printed.

In a popular game called "lotto" a person purchases a ticket but selects the combination of numbers at the time of purchase. Alternatively, the person may elect to have the provider of the lotto game randomly select the combination (this is commonly referred to as an "easy-pick"). At a predesignated time a "drawing" is made in which a combination is chosen as the winning combination. For example, in a game referred to as "6/49 lotto," a player selects any six numbers out of a total of forty-nine numbers. At the drawing, six numbers are drawn to select the winner. The player having the winning combination of six numbers is declared a winner. If there is more than one winner, then the "pot" is shared by all of the winners.

There are variations to the "6/49 lotto," wherein selecting three, four, or five numbers also results in a win of a smaller prize. In another variation, a seventh number is drawn as a "bonus" number at the time of the drawing. A player selecting five of the six winning numbers plus the "bonus" number is entitled to win an amount that is less than the amount for correctly selecting all six numbers, but more than the amount for selecting only five out of the six numbers. In other games, the player may select symbols other than numbers, such as playing cards, letters, etc.

In these lottery games, the players purchase the tickets at various authorized outlets, which are typically located at grocery, convenience, or other retail stores. In most instances, the tickets are provided in the form of a paper medium with the information printed thereon. For the lotto games, once a player's numbers are provided as inputs to a computerized tracking system, those selected numbers are then printed onto a predesignated paper form for the player to retain. For the "instant winner" game, the winning combination is preprinted on the ticket prior to the time of purchase, so that in many instances the player at the time of purchase can determine if he or she has won. Elaborate systems are available to conceal the preprinted combination so that the preprinted combination is revealed only after the ticket is purchased. One popular technique involves "scratching-off" a masking layer to expose the underlying preprinted combination.

In most instant games, the player exposes all the preprinted information on the ticket. A certain number of tickets have preprinted information entitling the players to certain prizes. That is, the specific tickets that will win are entirely predetermined (or "controlled") in advance at the time of manufacture.

In another type of instant game, the player exposes only some of the preprinted combinations needed to make the ticket a winning ticket provided the player chooses the correct portions of the ticket to expose. The specific tickets that will win are thus not predetermined in advance. Instead, the specific tickets that will win are determined at the time the player plays the ticket. In these games, the operator of the game typically relies on the laws of probability to cause a certain predictable percentage of the tickets to win. It is, however, theoretically possible for any ticket (and every ticket) to win.

It is to be noted that some form of paper medium, such as a paper slip or card, is retained by each of the players as a ticket or receipt to be later submitted or exchanged to claim the prize.

Radio Frequency Transmission and Reception

Various systems for radio frequency transmission and reception are of course well known. One type of a prior radio frequency transmission and reception system is disclosed in U.S. Pat. No. 4,021,807 of Culpepper et al. entitled BEACON TRACKING SYSTEM, U.S. Pat. No. 4,001,828 of Culpepper entitled BEACON TRACKING RECEIVER, and U.S. Pat. No. 4,023,176 of Currie et al. entitled BEACON TRACKING DISPLAY SYSTEM. Said patents disclose a system for tracking a remote radio frequency transmitter. Said patents disclose a schematic diagram for the remote radio frequency transmitter. The remote radio frequency transmitter includes an oscillator, a frequency multiplier, a modulation signal generator, an amplifier, and an antenna. Said patents also disclose a beacon tracking receiver that provides signals representative of the direction to and the distance to the remote transmitter. The receiver includes two intermediate frequency ("IF") channels that are switchably responsive to a left/right or fore/aft pair of antennas. The IF channels feed a phase comparator that provides a signal representative of the direction of the transmitter. An automatic gain control ("AGC") signal in one of the channels is employed as a measure of the proximity of the transmitter. Said patents also disclose a display system for a beacon tracking receiver, wherein the display system has both audible and visual displays for locating the transmitter of radio frequency energy.

SUMMARY AND OBJECTS OF THE INVENTION

One object of the present invention is to provide a ticket apparatus for a game, wherein the ticket apparatus includes a transmitter for transmitting a signal that indicates that the ticket apparatus includes a winning value.

Another object of the present invention is to provide a ticket system for a game, wherein locater means are provided for locating the ticket apparatus.

Another object of the present invention is to provide a method of playing a game, wherein locater means are used to locate the ticket apparatus.

A ticket apparatus for a game is described. The ticket apparatus includes storage means for storing a first value. A receiver is included for receiving a broadcast of a broadcast value for the game, wherein the broadcast value is broadcast over a first transmission medium. The ticket apparatus includes means for ascertaining whether the first value is a winning value in view of the received broadcast value. A transmitter responsive to the ascertaining means is included for transmitting over a second transmission medium a signal that indicates that the first value is the winning value if the first value is the winning value.

Other objects, features, and advantages of the present invention will be apparent from the accompanying drawings and from the detailed description that follows below.

BRIEF DESCRIPTION OF THE DRAWINGS

The present invention is illustrated by way of example and not limitation in figures of the accompanying drawings, in which like references indicate similar elements, and in which.

DETAILED DESCRIPTION

The term "lottery" is used extensively herein to denote a particular game in which a winner (or winners) is (are) selected from a plurality of players. It is to be appreciated that the aforementioned "instant winner" and "lotto" games are just two examples of lotteries and the present invention is not limited to just such examples. The present invention need not be limited to games of chance only. Games of skill can be readily implemented without departing from the spirit and scope of the present invention.

Further, throughout the description the term "winner" is used to designate one or more winners (the singular form is used for simplicity of explanation) and the term "ticket" is used to denote that item that is provided to the player to certify his or her play. A term "value" is used throughout to refer to numbers, letters, symbols, or other means of identification. Additionally, it is to be appreciated that a player need not necessarily purchase the ticket. Rather, the ticket can be given to a player for no consideration, such as for a commercial promotion. A winner can be awarded a prize or the game can be played purely for entertainment value, in which no prizes are awarded. Further, the winning prize, if any, can take various forms, including but not limited to, money, vacation trips, tangible goods, the opportunity to win additional or other prizes, the accumulation of points, or other recognition.

Figure 1:
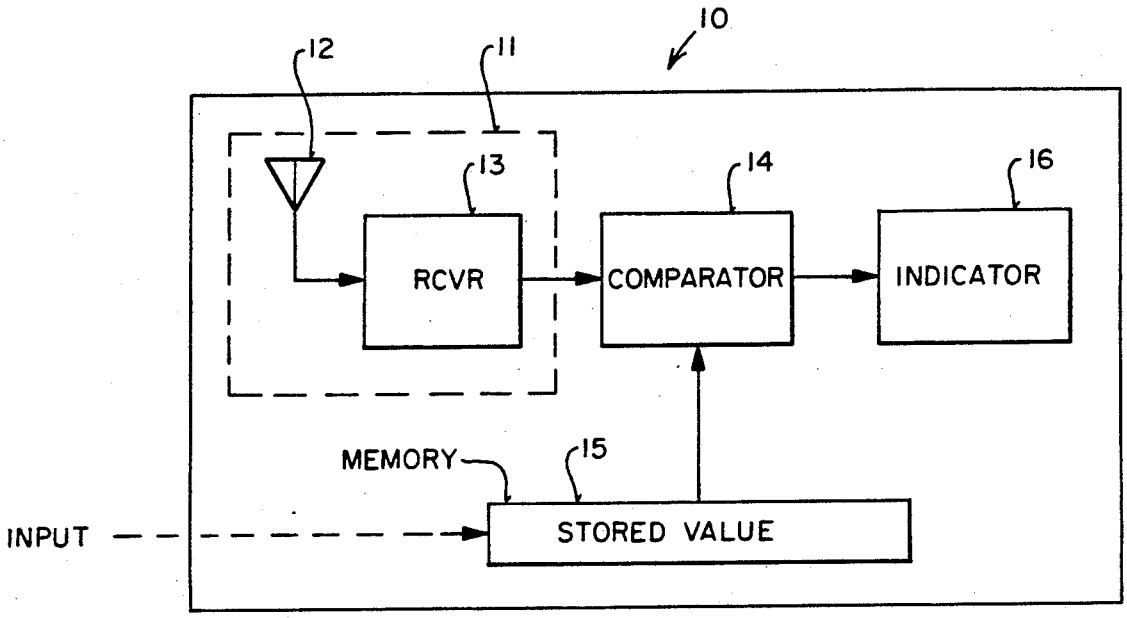
FIG. 1 is a block diagram of circuitry resident on a game ticket.

FIG. 1 shows a ticket 10. Ticket 10 is provided to each player of the lottery. As in other lottery games, ticket 10 can be used to designate one "play" and a player may acquire more than one ticket to play the same game.

Ticket 10 is comprised of a receiving means 11 for receiving a broadcast message. Where electromagnetic radiation is to be received, receiving means 11 is comprised of an input means such as an antenna 12 and a receiver 13 for extracting the intelligence (message). Where other mediums are used for transmission, such as telephonic, optical and eletro-optical, microwave, and laser, antenna 12 can be adapted for receiving such transmissions.

Once a signal is received, receiver 13 recovers the message and provides this message to a comparator 14. A variety of prior art receivers can be readily used or adapted to function as receiver 13. For example, common radio receivers can be used to receive messages sent by radio transmitters. The manner in which the message is broadcast from a transmitting source is not critical to the present invention as long as ticket 10 is capable of receiving and recovering the transmitted message.

The output of receiver 13, which is coupled to comparator 14, provides a message that contains a value. In one embodiment, this received value is digitally encoded. The received value is coupled as one input of comparator 14. Comparator 14 is also coupled to receive as its second input a stored coded value from memory 15. In one embodiment, this stored value is also digitally encoded. One embodiment uses an integrated circuit memory for memory 15. In alternative embodiments, memory 15 could be comprised of one of a variety of other memory devices, including a register, an optical device, or a magnetic memory, such as a magnetic strip, etc.

Within memory 15 a coded value is stored and retained. Comparator 14 compares the stored coded value of memory 15 to the coded value received from receiver 13. It is to be noted that memory 15 can be readily included as part of comparator 14.

If the two coded values match, comparator 14 provides an indication to indicator 16. If no match occurs, a "no match" indication can be provided to indicator 16, or, alternatively, no indication need be provided. Indicator 16 indicates a match condition, but need not indicate a "no match" condition, although it can, if desired. The indication can be in a form noticeable to one of the senses. One embodiment utilizes a visual and/or an audio alarm to provide the indication.

A variety of techniques can be used to store a coded value in memory 15. For example, an integrated circuit memory, such as an electrically programmable read-only memory ("EPROM") or an electrically programmable and electrically erasable read-only memory ("EEPROM") can be programmed to store the coded value. The encoded value in memory 15 can be stored when ticket 10 is manufactured or can be stored at a later time. In one scheme, a predesignated coded value is stored in memory 15, wherein the player acquiring ticket 10 has no choice as to the selection of the stored coded value. In another scheme, the player prior to, at the time of, or after acquiring ticket 10 is able to select the value that is to be stored in memory 15.

Figure 2:
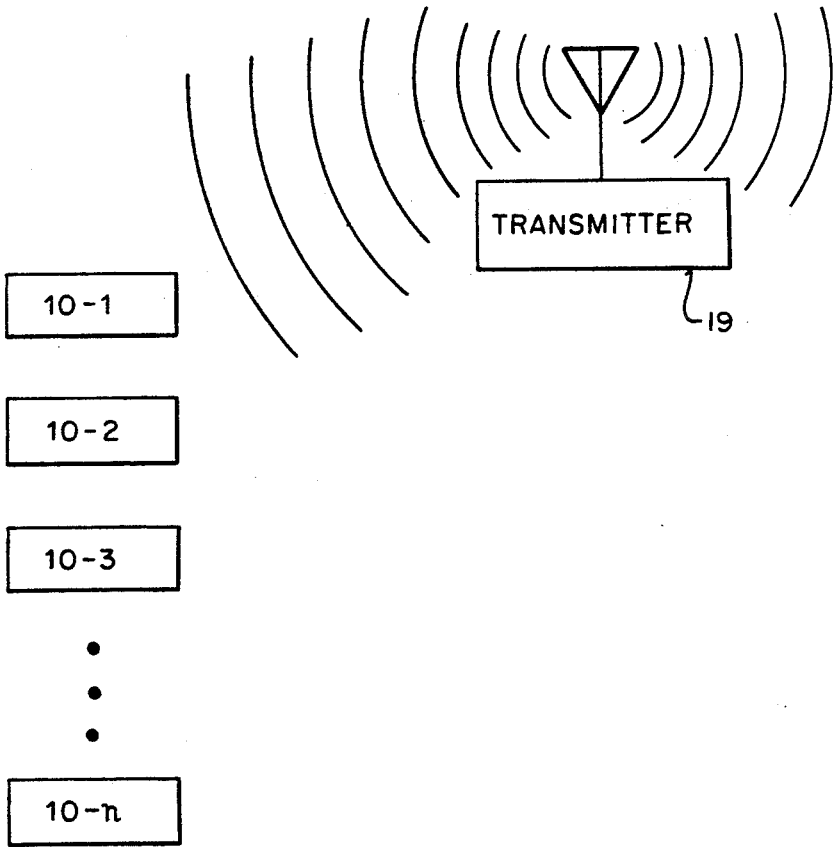
FIG. 2 is a diagram showing the braodcasting of information to a plurality of tickets.

As shown in FIG. 2, a plurality of tickets 10 are needed to play a given lottery game. The plurality of tickets 10-1 through **10-*n* are distributed to a plurality of players. The actual number of tickets 10, as well as the number of players, is a design choice and will depend on the type of lottery game being played. If the scheme involving predesignated coded values is used in the selected lottery game, each ticket 10 has a predesignated coded value stored within its memory 15. A different value can be stored in each ticket 10** or, alternatively, duplication can occur.

A winner of the lottery is chosen as the player having a ticket 10, which has within its memory 15 a coded value corresponding to the winning value. The winning value can be determined prior to, during, or after distributing ticket 10. If the winning value is known at the start of the lottery game, then the sponsor of the game can select the maximum possible number of winners by encoding the tickets accordingly. If the winning value is to be determined at a later time, such as by a drawing, then the sponsor ordinarily would be careful not to replicate the same code in a large number of tickets in the event that coded value is drawn, which otherwise would result in a large number of winners. Of course, the winning pot can be shared among the winners in a game having multiple winners.

At a designated time a winner is announced. The announcement is made by broadcasting the winning coded value from transmitter 19. Transmitter 19 can be of a simple hand-held device for short range operation as when providing a game in a casino, in some other confined physical area, or in a limited physical area such as a particular city. Alternatively, transmitter 19 can be a high power unit requiring a sizeable transmitting facility for long range operation, such as when providing a state lottery game. Transmitter 19 is typically under the control of the sponsor of the lottery. In games having a significantly large number of players, the information provided to transmitter 19 can be computer controlled. At a designated time a message containing the winning code is transmitted (broadcast) from transmitter 19 and this code is received by tickets 10. Receiving means 11 in each ticket 10 receives the transmitted message and recovers the transmitted code for processing. For one embodiment, an unsecured message, is broadcast. Various security devices or techniques, however, can be readily implemented to provide secure transmission and reception of the broadcast message.

The winning code is coupled to comparator 14. Comparator 14 compares the winning code to the stored code in memory 15. If the coded value stored in memory 15 is the same as the winning code received, then this match is detected by comparator 14. Comparator 14 then sends a signal to indicator 16, which provides an audio and/or visual indication that the ticket is a winning ticket. The player holding this winning ticket 10 can then proceed to the next step, which typically will be to claim an award or a prize. Multiple winners are possible if multiple winning codes are distributed.

The above described scheme that includes the use of predesignated stored codes can be readily adapted to provide the earlier described "instant winner" game. The transmitter can be made to send winning code messages at frequent time intervals or even continuously.

Figure 3:
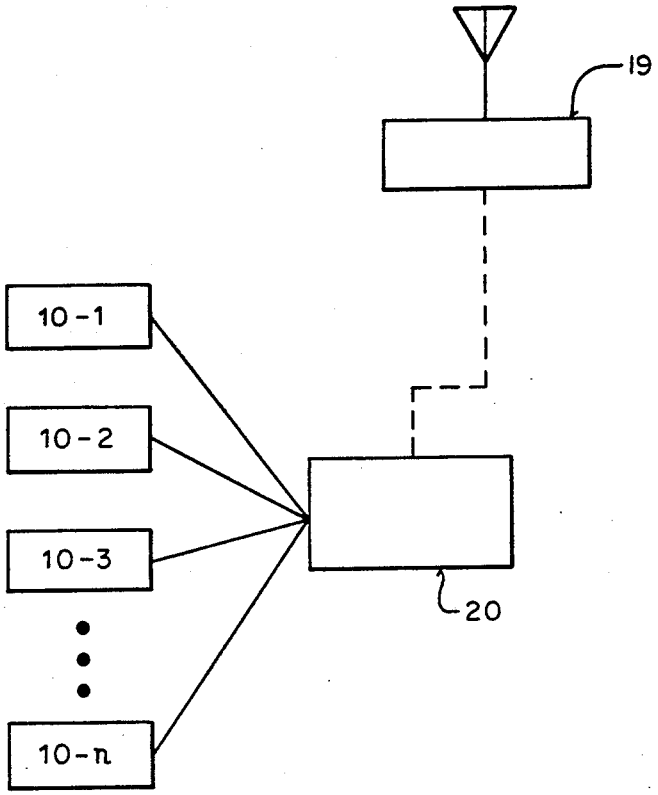
FIG. 3 is a diagram showing the use of an interfacing device to provide information to the tickets.

In the other scheme where a player is able to select the code value at the time of, or prior to, acquiring the ticket, an additional mechanism is needed to place the selected code in memory 15. FIG. 3 depicts mechanism 20 that is used to store the selected value in memory 15 of each ticket 10. The exact nature of mechanism 20 will depend on the composition of memory 15. For example, if memory 15 is an EPROM, then mechanism 20 will be a "burn-in" device for programming the coded value in the EPROM. Although one mechanism 20 is shown in FIG. 3, a plurality of mechanisms 20 could alternatively be used.

This second scheme can be readily adapted for the earlier described lotto game. For example, in a 6/49 lotto game, six numbers selected by a player are stored in memory 15. If a player chooses, the six numbers can be randomly selected (downloaded) by the sponsor. This is similar to the aforementioned "easy-pick." Alternatively, all the numbers can be stored in memory 15 and those chosen by a player can be activated (or those not chosen can be erased). The six winning numbers are broadcast by transmitter 19 after the ticket distribution has terminated. Receiving means 11 deciphers all six winning numbers. Comparator 14 compares the six stored numbers to the six received numbers and indicates the number of matches. A visual indication is used in one preferred embodiment where multiple indications are needed by indicator 16, but other indications can be used. In this lotto game the winning prize or award, if any, is dependent on the number of matches. Additionally, it is to be appreciated that modifications to this basic lotto game can be implemented without departing from the spirit and scope of the present invention. For example, a bonus (seventh) number can be used.

Further, in a third scheme that will be described later, an internal mechanism generates the value. This internal generation of values, which could be changed internally also, could be used in probability types of games (not predetermined win).

Transmitter 19, which broadcasts the winning value or values, along with the transmission medium, determines the mode of the device used. Where radio transmission is used, each ticket 10 can receive and process the signal, assuming the ticket is within range of the transmitter 19. Where other broadcasting techniques are used, a special receiving device may be required. In such a case, an additional device for coupling a ticket to telephone lines for receiving the broadcast will be needed. Such a device can be built into the ticket itself. It is, however, more economical to have a separate device for providing the interface between the telephone lines and the ticket. Such a device would need to implement a modem (i.e., modulator-demodulator) for converting audio telephone signals to digital signals. Other forms of transmissions, including those using optics, electro-optics, and other electromagnetic waves can be used. Further, multiple transmitters 19 can be used to broadcast the winning value(s) instead of a single transmitter 19.

Although ticket 10 of FIG. 1 shows a specific diagram, other schemes can be implemented. For example, in some instances all but memory 15 can be removed from a ticket 10 and placed within the interface device, such as device 20 of FIG. 3. In this instance, each ticket 10 will necessarily need to be coupled to device 20 to determine if it is a winner. In some instances value(s) can be downloaded from transmitter 19 for storage.

Ticket 10 can be constructed from a variety of materials and implemented in various forms. One embodiment utilizes a plastic housing enclosing an integrated circuit and is shaped so as to have a substantially flat rectangular body. The actual shape and the materials used are, however, design choices. If ticket 10 is used for a promotional purpose, ticket 10 can be incorporated in a wrist watch, pen, or desk clock, such that after the lottery is run, the players retain and obtain the functionality of the watch, pen, or desk clock, etc. Further, ticket 10 of the present invention can be used once or in a number of games.

Although various games can be implemented, an example of a specific game will illustrate the principles involved. In this game, the stored value in the ticket apparatus is comprised of a single 9-digit decimal number. The singe 9-digit number might be "123456789." The game is played with a random drawing in which a winning 9-digit value is drawn every hour on all 365 days of the year. That is, there are 8760 drawings per year. In this game, the player might purchase his or her ticket for $87.60 per year (i.e. $0.01 per drawing). The rules of the game are such that the player wins the largest prize if his or her 9-digit number exactly matches the 9-digit number that is drawn on any drawing during the year. In addition, the player wins smaller prizes if he or she has a partial match consisting of the last (rightmost) 8, 7, 6, or 5 digits.

The prize structure below shows the economics of the game. The prize structure is based on 1,000,000 ticket apparatuses being sold. Thus, there is $87,600,000 in total revenue from the sales of tickets. Over the course of an entire year, there are 8,760,000,000 individual plays (8760 times 1,000,000).

| GET | PRIZE | ODDS | EXPECTED NUMBER OF WINNERS IN 8,760,000,000 | EXPECTED PRIZE COST IN 8,760,000,000 |
|---|---|---|---|---|
| Match all 9 digits | $1,000,000 | 1:1,000,000,000 | 8.76 | $8,760,000 |
| Match last 8 digits | $100,000 | 1:111,111,111 | 78.84 | $7,884,000 |
| Match last 7 digits | $5,000 | 1:11,111,111 | 788.40 | $3,942,000 |
| Match last 6 digits | $500 | 1:1,111,111 | 7,884.00 | $3,942,000 |
| Match last 5 digits | $200 | 1:111,111 | 78,840.00 | $15,768,000 |
| | TOTAL | 1:100,000 | 87,600.00 | $40,296,000 |

The odds that the 9-digit value residing on any particular ticket apparatus will exactly match the 9 digits drawn at any particular drawing are 1 in 1,000,000,000. Thus, over the course of the entire year, one can expect that there will be 8.76 such exact matches among the 8,760,000,000 individual plays. If the prize for such an exact match is $1,000,000 cash, then the expected prize cost for the entire year is $8,760,000.

In addition, in the course of a year, one can expect 87.60 occasions when the last (right most) 8 digits on some players' tickets will partially match the 9-digit number drawn. Excluding the expected 8.76 occasions when there will be an exact match, there will then be an expectation of 78.84 partial matches of 8 digits. If a prize of $100,000 cash is awarded for such a partial match, then the expected prize cost will be $7,884,000. The odds of such a partial match are 1 in 111,111,111 (i.e. 8,760,000,000 divided by 78.84).

The odds, expected number of winners, and expected prize cost are computed in a similar manner for partial matches of 7,6, and 5 digits. The total expected prize cost for the entire game is thus $40,296,000 for the year. This amounts to 46% of the revenues from the game. Many state-operated government lotteries pay out approximately 46% of their revenues in prizes to the players. Thus, the above prize structure might be a viable prize structure for many state-operated lottery games. There is an expectation of 87,600 winners so that the odds of winning will be 1:100,000 for any individual play. Because each ticket apparatus participates in 8,760 individual plays in the course of the year, the odds of winning for a particular ticket apparatus sometimes during the year are about 1 in 11.4.

The 9-digit winning value that is randomly drawn is broadcast to all players immediately after each drawing. There will be 8,760 such broadcasts during the year. A typical broadcast message will contain two starting symbols (**), two decimal digits indicating the total length of the current message, one decimal digital indicating the particular game being played (among all such games that might be simultaneously played and broadcast), four decimal digits indicating the particular drawing number (1 through 8760), nine decimal digits indicating the 9-digit winning value drawn, two decimal digits for a check code to verify accuracy of transmission of the message, and two ending symbols (##). Thus, the total length of the message would be 22 symbols. These 22 symbols do not include the preliminary address code which may also be transmitted by a particular protocol, such as by a Motorola BPR broadcast and network system.

For example, suppose that the 9-digit value 444444444 is drawn on the 8760th drawing of the year (i.e., the last drawing of the year) for game no. 1. The message would then be **2218760444444444437##. This message is interpreted as follows: the message has length 22, applies to game no. 1, relates to the 8760th drawing of the year, reports that the winning value for the drawing is 444444444, and has the check code 37 for verifying the accuracy of transmission. If the particular ticket apparatus has stored value 123456789 for game no. 1 it would not be a winner for this particular drawing.

Figure 4:
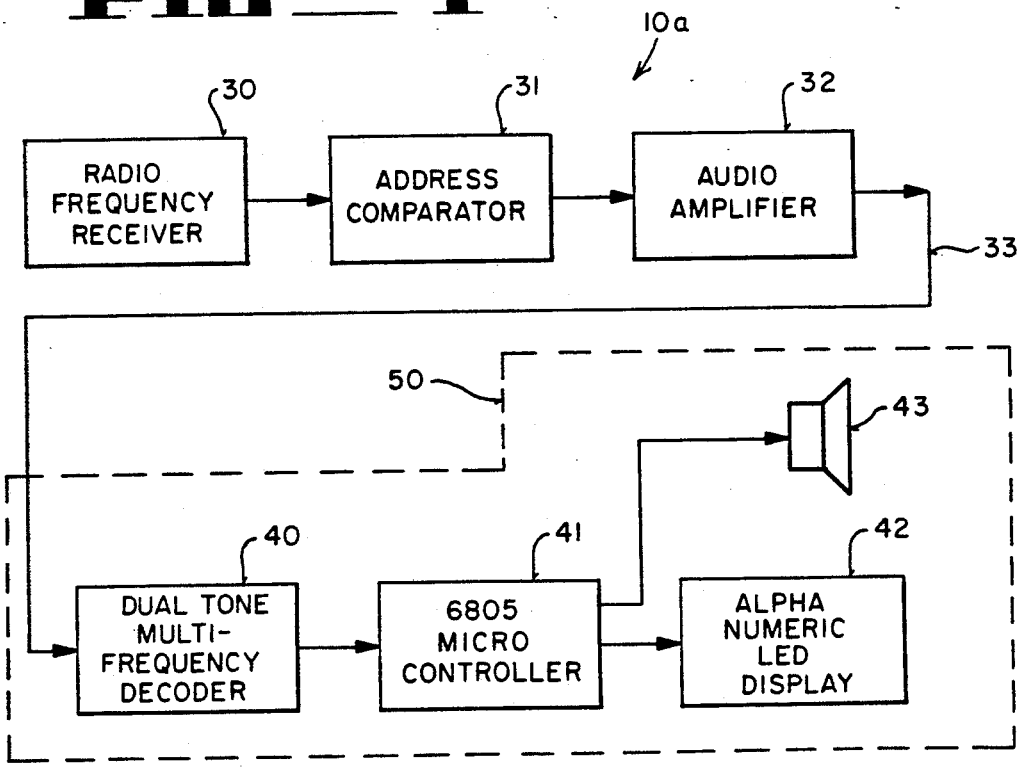
FIG. 4 is a block diagram showing additional details of circuitry resident on a game ticket.

FIG. 4 shows specific circuitry used in the one embodiment. Although a specific example, including a specific network, is described, other circuitry and networks can be readily implemented.

A broadcast message is broadcast by a Motorola BPR 2000 regional network. Pacific Telesis (Pactel), for example, broadcasts using the Motorola BPR 2000 system. More than 100 transmitters in the San Francisco, Calif. Bay Area use a frequency of 152.24 Megahertz for the area approximately within 20 miles of downtown San Francisco and use a frequency of 929.8875 Megahertz for the wider area from Monterey to Fresno and Marysville, Calif. The voice feature of the Motorola BPR allows the sending of messages to the individual apparatus by using touch-tones from a standard telephone. These tones are relatively insensitive to noise and distortion.

The broadcast message is received by a radio frequency ("RF") receiver 30 of apparatus 10*a*, which operates substantially equivalent to ticket 10 of FIG. 1 in overall function. Part of the broadcast message is an address code that is used to identify the broadcast message as one appropriate for the particular game and apparatus. The address in the broadcast message is compared to the address stored in address comparator 31. If the addresses agree, the message received is then passed on to an audio amplifier 32. The amplifier 32 amplifies the signal received from comparator 31.

The output signal 33 from the audio amplifier 32 is then coupled to a dual-tone multi-frequency ("DTMF") decoder 40. A Motorola 6805 Microcontroller is used as a processor 41 in one embodiment and makes periodic inquires of the DTMF decoder 40. When a valid 4-bit signal (representing up to 16 different possibilities) is present at decoder 40 at the time of inquiry, this information is provided to the microcontroller 41. The microcontroller 41 continues to make such inquiries of decoder 40 until a complete message comprising a sequence of such 4-bit signals is accumulated in microcontroller 41. For example, the entire message (excluding the address code) can be comprised of 22 such 4-bit signals.

In this particular embodiment, the microcontroller 41 contains the stored value(s) for the player. The microcontroller 41 then determines if the stored value for the player is a winner in the game, given the message received. This determination is made based on the particular rules and prize structure of the particular game being played. If, for example, the stored value for the player is the 9-digit number 123456789 and the broadcast winning value is 333333333, then this particular ticket apparatus is not a winner on this particular occasion. If, on the other hand, the broadcast winning value is 999956789, then this particular ticket apparatus is a winner by virtue of having a partial match consisting of the last (right most) five digits 56789.

If the stored value for the player is a winner in the game, microcontroller 41 causes an audio alarm 43, such as a beeper, to emit an audible sensory indication to the player. In addition, microcontroller 41 causes a visual indicator 42, such as an alphanumeric light emitting diode (LED) display device, to display a visual alphanumeric message to the player (such as "Win $200"). If the stored value for the player is not a winner in the game, the microcontroller 41 does not activate the beeper 43. It can, however, display the 9-digit winning value on LED 42. Microcontroller 41 includes software routines for providing the necessary programming and operation of device 10*a*.

Figure 5:
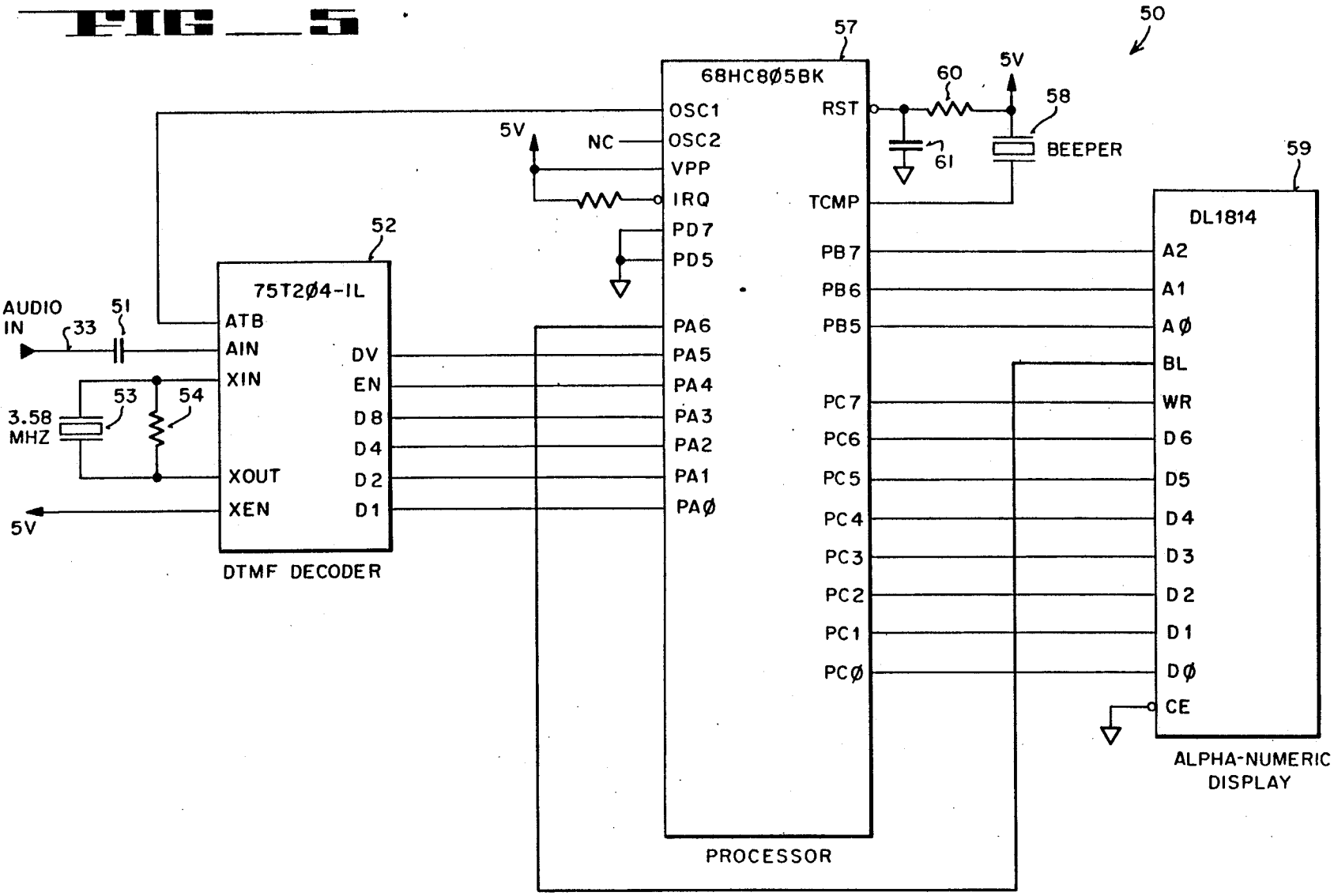
FIG. 5 is a schematic diagram showing additional details of circuitry for processing a signal received by circuitry resident on the game ticket.

FIG. 5 provides additional details of the portion 50 of the circuitry, as represented by units 40–43 of FIG. 4. The audio signal 33 from amplifier 32 of FIG. 4 is coupled as an input to circuit 50.

The DTMF decoder 40 is implemented by a microprocessor chip 52, specifically a Silicon Systems 75T204-IL chip. This chip 52 converts the 16 standard DTMF touch-tone tones generated by a touch-tone telephone into a 4-bit hexadecimal code. The audio input signal is coupled through a capacitor 51, which is a 0.01 microfarad (μF) capacitor, to pin input AIN of decoder chip 52. Decoder chip 52 calls on a standard color-burst crystal 53 operating at 3.579545 Megahertz and a resistor 54 coupled in parallel across pins labeled XIN and XOUT on the 75T204-IL decoder chip 52.

The microcontroller 41 of FIG. 4 is implemented as a microprocessor controller chip 57 in FIG. 5. Inquiries to decoder chip 52 are initiated by the controller chip 57 at the EN pin of decoder 52. The DV pin responds to such inquiries by indicating the presence of a valid single touch-tone signal. Each such signal is one of 16 possibilities (hexadecimal). The D1, D2, D3, and D4 pins, respectively, provide the 4-bit signal (hexadecimal signal) representing the single touch-tone tone to the controller chip 57.

The microprocessor controller chip 57 of one embodiment is a Motorola MC68HC805BK chip. This chip is one of the 6805 family of chips. This chip 57 is a highly compact chip packaged in a small 28 lead SOJ (surface mount) package. The controller chip 57 uses the block output of the decoder chip 52 as a time base. The controller chip 57 contains 2K bytes of PROM implemented as an EEPROM memory, 128 bytes of scratchpad Random Access Memory (RAM), and 21 Input/Output ("I/O") lines. This microprocessor controller chip 57 does the work of interpreting the broadcast signal into game terms. In particular, it accumulates the single hexadecimal touch-tone signals into a complete message. This message is comprised of a designated special starting symbol and a designated special ending symbol as described. This message contains a field indicating the specific game involved and additional fields containing the broadcast values for the game. The controller chip 57 determines whether the stored values in the chip are a winner for the game, given the broadcast values.

The functionality of the microprocessor controller chip 57 derives from its internal program. This program resides in the EEPROM of chip 57 and is inserted into this EEPROM using the Motorola Development System M68HC05EVM and a computer terminal.

The beeper 43 from FIG. 4 is implemented as a piezoelectric transducer 58 and is connected to a resistor 60 and capacitor 61. It is coupled to the RST pin of chip 57 through resistor 60 and the other terminal to the TCMP pin of chip 57. Capacitor 61 is coupled between the RST input and ground. A supply voltage, 5V in this instance, is coupled to the junction of transducer 58 and resistor 60. In one embodiment resistor 60 is 10K ohms and capacitor 61 is 1.0 μF. This piezoelectric transducer 58 produces an audible sensory indication of a winner upon command of chip 57.

The alphanumeric LED display 42 of FIG. 4 is implemented as display device 59 in FIG. 5. The display device 59 is a Siemens DL1814 red 8-character LED display device. Each character is composed of 16 segments and is 0.112 inches high. Any of 64 characters may be displayed using this display device 59, including all numbers and all upper case letters.

One embodiment is powered by a standard 6 volt batteries. Voltage dividers provide the 1.5 volt power required by units 30, 31 and 32 of FIG. 4 and the 5.0 volt power required by units 40–43 (units 52, 57–59 in FIG. 5).

It is anticipated that existing trends toward improvements in performance and price in the electronics industry will cause the power requirements, physical size, and cost of the components performing the fundamental operations of this apparatus described herein to decrease dramatically over time.

In the description above, the stored values of the game for the player are stored in the memory of the microprocessor controller chip 57. These stored values of the game for the player may be determined at the time of manufacture of the apparatus. Different values would typically be inserted into different parts. It is possible, however, for the player to select his or her own values of the game. As described earlier, this can be accomplished by connecting the apparatus to an impregnating device that inserts the values of the game chosen by the player into the apparatus. This impregnating device might be located at retail locations, such as a store that sells the lottery tickets or distributes the promotional game tickets.

Figure 6:
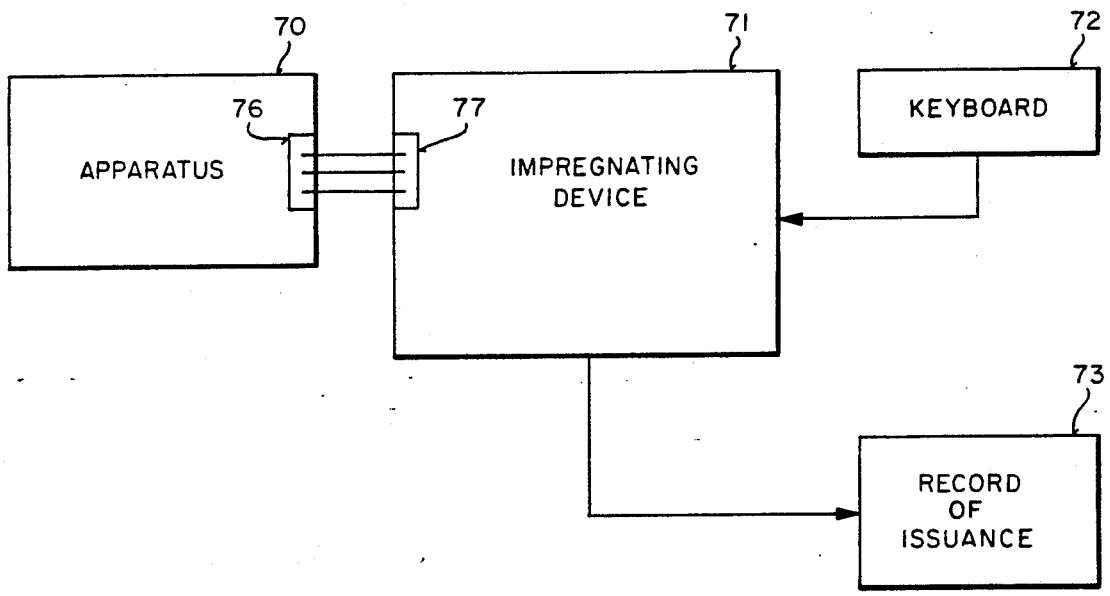
FIG. 6 is a diagram showing the selection of a value by a player, an assignment of the selected value to a ticket by an impregnating device, and a recording of such selection at a central information repository.

FIG. 6 is a diagram showing a selection of a value by the player, an assignment of the selected value to the ticket by an impregnating device, and a recording of such selection at a central information repository. In FIG. 6, an apparatus 70 (i.e., the game ticket) is presented by a player at the retail location. The apparatus 70 is connected to an impregnating device 71 via a connector 76 of the apparatus 70 and connector 77 of the impregnating device 71. A keyboard 72 coupled to the impregnating device 71 allows the entry of the values of the game desired by the player. This keyboard may be operated by either the player or a clerk and be part of a vending machine and could further be with a coin slot. The impregnating device 71 causes signals to be created and transmitted to the apparatus 70 and entered into a memory resident on the apparatus 70. The EEPROM of the microprocessor controller chip 57 will provide that function when controller chip 57 is used in the apparatus 70.

Appropriate validation and security codes accompany the game values to assure the validity of the game values in event of a win. Before a prize is paid, the stored game values of the player must qualify for a prize given the broadcast values. In addition, the stored game values must agree with (1) an encrypted version of the stored game values in the apparatus, as well as with (2) a record 73 of the stored game value and an additional validation code created at the time of issuance of the game value, retained at a central site operated by the sponsor of the game. It is appreciated that the earlier described apparatus of FIGS. 4 and 5 can be readily used to provide apparatus 70.

It is to be noted that it is also possible that the player could choose to allow the impregnating device to randomly generate the new game values for his or her apparatus (i.e., the easy pick) and impregnate such new random values in his or her apparatus. Also the new game values could be supplied via a separate paper game ticket, in the form of an optically scannable printed bar-code, optically readable printed characters, information encoded on a magnetic strip, or other such means.

The impregnating device 71 creates a record 73 of issuance of the game value selected by the player. The record of issuance would typically be a signal sent via dedicated telephone lines to a central computer maintained by the sponsor of the lottery or promotional game. This record of issuance could, however, also be in the form of a printed paper record or a magnetic memory device (such as a floppy disk). This signal contains the game values selected, as well as the time and date of issuance and other administrative information appropriate to the game.

Finally, it is possible for the game values to be generated by the controller chip 57 itself using a program. This program would generate a sequence of game values using a pseudo-random algorithm. Such pseudo-random algorithms are well known in the prior art and are capable of generating a sequence of seemingly random, seemingly unpredictable, and seemingly unrelated game values. In fact, however, the entire sequence of such seemingly random values is generated in an entirely deterministic way by the mathematical algorithm involved and thus capable of precise verification of validity in event of a win. Then, as each new winning value is broadcast, the apparatus determines whether the newly computed, seemingly random stored value in the apparatus is a winner in the game given the broadcast values.

Thus, the stored values of the game in the ticket apparatus may arise in any one of the three ways, namely, created at the time of manufacture, created as a result of a selection and request initiated by the player, or internally created by the microprocessor controller in the apparatus just prior to the broadcast of the winning values.

It is to be appreciated that although a particular game is outlined above with respect to one embodiment, said embodiment could be readily adapted to other games in that there are many types of game values that may be on a ticket. Lottery games and promotional games often use a single multi-digit number, such as a 6-digit number for example. Other games use multiple multi-digit numbers, often of varying lengths. Still other games use a group of numbers, such as the group of 6 numbers from 1 to 49 used in "lotto" games. Further, other games use symbols or groups of symbols, such as symbols of playing cards (e.g. Ace of Hearts, etc.) or letters of the alphabet. Some games allow repetition of the digit or symbols in the game value, while other games do not allow repetition. For example, the digits 0–9 may recur in any of the 6 positions in a 6-digit number, wherein the numbers 1–49 used in a typical lotto game and the playing cards in a typically card game do not recur.

A variation of the lottery game can be provided using words of a given language, such as English. In an alternative implementation, a player selects a word from a collection of preselected words and wins if the player's selected word matches the winning word drawn from the set. The set of words can be provided to the players by various means, including floppy disks, CD-ROM compact disks, or by other references to an established dictionary.

Similarly, there are many variations in the types of values that may be broadcast. In some games, there is only one number drawn, for example one 6-digit number may be drawn, while in other games multiple numbers may be drawn. In some games, there may be repetitions among the numbers drawn, while in other games, such as lotto, there are no such repetitions.

The type of broadcast need not be limited to telephone or RF transmission. It may be by microwave, x-ray, light from a laser, as well as by other well-known transmission means. Further, one or multiple broadcasting points can be used.

The types of games include, but are not limited to, (1) games wherein the ticket is given to the player for no consideration (e.g., a promotional game) and a prize can be won; (2) games wherein the ticket is purchased by the player (e.g., a state-operated lottery) and a prize can be won; and (3) games wherein the ticket can be purchased or given away wherein the game is played for entertainment or amusement and a tangible prize cannot be won, but wherein points may be won or other recognition given.

There are games of chance and games of skill. Both may be practiced by the apparatus described herein. Most state-operated lottery games are games of chance. The broadcast values may, however, be the outcome of a sporting contest, such as a football game, and the stored values of the game for a player may be that particular player's bet on the outcome of the sporting contest. Such games require skill by the player in making his or her choice of a bet on the outcome of the game.

Various additional schemes and techniques well known in the art that are associated with portable memory devices, credit cards, and lottery tickets can be readily adapted to function with tickets of one or more embodiments. For example, security means for preventing unauthorized alteration of the values or the range of values can be readily included within the ticket of one embodiment. Means to render the ticket inoperable if such unauthorized alteration is attempted can also be included.

Figure 7:
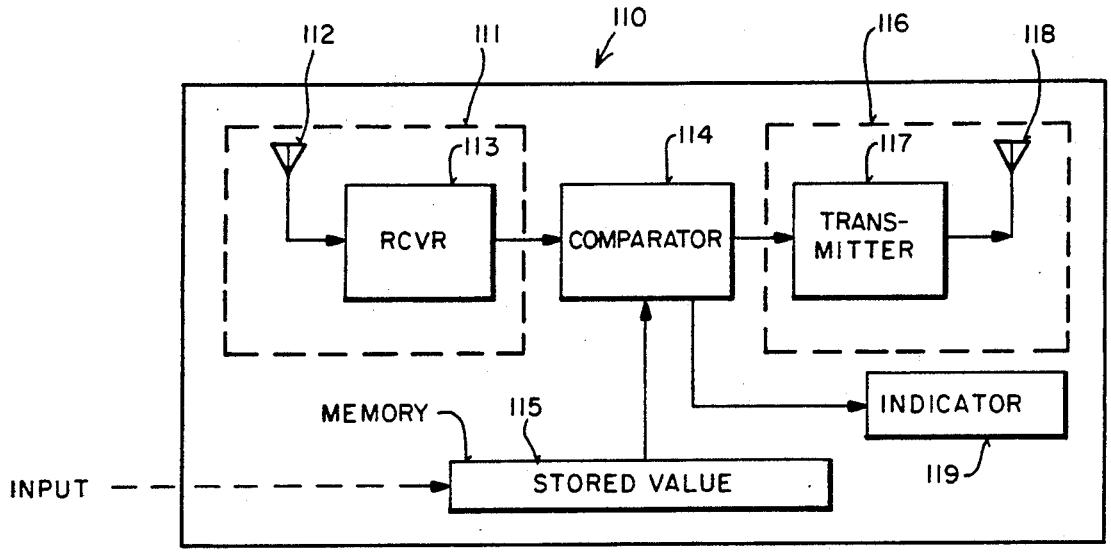
FIG. 7 is a block diagram of circuitry resident on a game ticket with a transmitter.

FIG. 7 illustrates a ticket apparatus 110 that includes both a receiver and a transmitter. Ticket apparatus 110 is provided to each player of a lottery game. As in other lottery games, ticket apparatus 110 can be used to designate one "play" and a player may acquire more than more ticket to play the same game. Ticket apparatus 110 is also referred to as electrical ticket 110 or simply ticket 110.

Ticket 110 includes receiving means 111 for receiving a broadcast message. In one embodiment, receiving means 111 includes an antenna 112 coupled to a radio frequency receiver 113. Antenna 112 and receiver 113 receive a radio frequency signal. In alternative embodiments, transmissions to receiver 113 are made using telephonic means, optical means, electro-optical means, microwave means, and laser means. In alternative embodiments, antenna 112 is modified to suit the particular transmission medium.

Where radio transmission is used, each ticket 110 can receive and process the signal, assuming the ticket is within range of the transmitter. Where other broadcasting techniques are used, a special receiving device may be required. In such a case, an additional device for coupling a ticket to telephone lines for receiving the broadcast is used. Such a device can be built into the ticket itself. Alternatively, a separate device provides the interface between the telephone lines and the ticket. Such a device includes a modern (also referred to as a modulator-demodulator) for converting audio telephone signals to digital signals.

Once a signal is received, receiver 113 of a preferred embodiment recovers the message and provides the message to comparator 114. A variety of prior at receivers can be readily used or adapted to function as receiver means 111. For example, in one embodiment, receiver means 111 comprises a radio pager. Alternatively, any common radio receiver could be used to receive messages by a radio transmitter. The manner in which a message is broadcast from a transmitting source is not critical to the present invention as long as ticket 110 is capable of receiving and recovering the transmitted message.

The output of receiver 113 is coupled to comparator 114. Receiver 113 provides a message that contains a value, and receiver 113 provides that message to comparator 114. In one embodiment, this received value is digitally encoded. The received value is coupled as one input to comparator 114.

Comparator 114 is also coupled to receive as its second input a stored coded value from memory 115. In one embodiment, this stored value is also digitally encoded. In one embodiment, the stored value is assigned to ticket 110. In an alternative embodiment, the stored value of memory 115 is generated by a pseudo-random number generator located within ticket 110.

One embodiment uses an integrated circuit memory for memory 115. In alternative embodiments, memory 115 could be comprised of one of a variety of other memory devices, including a register, an optical device, or a magnetic memory. In an alternative embodiment, memory 115 is included as part of comparator 114.

Within memory 115 a coded value is stored and retained. Comparator 114 compares the stored coded value of memory 115 to the coded value received from receiver 113 in order to determine whether ticket 110 is a winning ticket in view of the rules of the applicable game. In one embodiment, the rules of the game are such that ticket 110 is a winning ticket if the coded value stored in memory 115 matches the coded value received from receiver 113. Comparator 114 inspects or analyzes the coded values to see whether or not such a match occurs.

It is to be appreciated that numerous alternative rules could apply, and that in alternative embodiments comparator 114 ascertains whether ticket 110 is a winning ticket in view of those alternative rules. In one alternative embodiment, ticket 110 is a winning ticket if there is a partial match between the stored coded value of memory 115 and the coded value received by receiver 113. For example, ticket 110 is a winning ticket if five numbers stored as the coded value of memory 115 match five of nine numbers of the coded value received by receiver 113. Comparator 114 looks for such a five out of nine match.

In another alternative embodiment, ticket 110 is a winning ticket if the stored coded value of memory 115 completes a sequence begun by the coded value received by receiver 113. For example, in one alternative game, a winning sequence comprises the five highest cards of a suit. If the coded value received by receiver 113 represents only three of the highest cards of a suit but the coded value of memory 115 represents the other two highest cards of that same suit, then ticket 110 is a winning ticket. Comparator 114 ascertains whether the winning sequence has occurred.

In yet another alternative embodiment, ticket 110 is a winning ticket if the stored coded value of memory 115 does not match the coded value received by receiver 113. Comparator 114 identifies whether or not there has been a match.

In one embodiment, if comparator 114 ascertains that the stored coded value of memory 115 is a winning value, then comparator 114 sends signals so indicating to transmitter 117. Transmitter 117 is a radio frequency transmitter. Transmitter 117 is part of transmitter means 116 that also includes antenna 118 coupled to transmitter 117. Transmitter means 116 broadcasts a signal that indicates that electrical ticket 110 is a winning ticket. The signal is broadcast using transmitter 117 and antenna 118.

In alternative embodiments, means such as telephonic means, optical means, electro-optical means, microwave means, and laser means are used as transmission means. In alternative embodiments of the present invention, transmitter 117 and antenna 118 are modified to allow transmission using said alternative means.

The transmission from the transmission means 116 of ticket 110 is received by a beacon tracking system described in more detail below in connection with FIG. 8. The beacon tracking system, also referred to as locater means, includes antennas, a receiver, and a display. The beacon tracking system is a means for determining the physical location of ticket 110 when ticket 110 is broadcasting a signal that indicates that ticket 110 is a winning ticket. In one embodiment of the present invention, the beacon locater means are operated by the sponsor of the lottery.

If comparator 114 of FIG. 7 ascertains that ticket 110 is a winning ticket, comparator 114 also provides a signal or indication to indicator 119. Upon receipt of this signal, indicator 119 provides an indication that ticket 110 is a winning ticket, or in other words, that the stored coded value of memory 115 is a winning value. In one embodiment, indicator 119 also provides an indication that lets the holder of ticket 110 know that ticket 110 is not a winning ticket if comparator 114 ascertains that ticket 110 is not a winning ticket in view of the received broadcast value. In an alternative embodiment, if ticket 110 is not a winning ticket, then indicator 119 simply does nothing, which in turn informs the holder of ticket 110 that ticket 110 is not a winning ticket.

In one embodiment, the indication provided by indicator 119 is in a form noticeable to one of the human senses. In one embodiment, indicator 119 provides a visual indication in the form of words or numbers or both. In one embodiment, the visual indication indicates how much money the ticket holder has won. In another embodiment, indicator 119 provides an audio alarm as an indication. In another embodiment, indicator 119 provides both a visual and an audio indication. In yet another embodiment, indicator 119 is a vibrator that provides a vibrational indication if ticket 110 is a winning ticket.

In one embodiment, an integrated circuit memory, such as an EPROM or an EEPROM, comprises memory 115 and is programmed to stored a coded value. A variety of techniques can be used to store the coded value in memory 115. In one embodiment, a value is stored in memory 115 when ticket 110 is manufactured or well before the time the player purchases ticket 110. For that embodiment, the player acquiring ticket 110 has no choice as to the selection of the stored coded value.

In another embodiment, the player is able to select the value that is to be stored in memory 115 either prior to acquiring the ticket, at the time of acquiring the ticket, or after the player acquires the ticket 110. In one embodiment, mechanism 20 of FIG. 3 is used to place a selected code in memory 115. In one embodiment, memory 115 is an EPROM and mechanism 20 is a "burn in" device for programming the coded value in EPROM memory 115. In another embodiment, impregnating device 71 and keyboard 72 of FIG. 6 are used to enter code into memory 115 for storage. In one embodiment, memory 115 comprises an EEPROM that is part of a microcontroller integrated circuit. For that embodiment, impregnating device 71 of FIG. 6 sends to the microcontroller the value that is to be impregnated into the EEPROM memory 115.

Figure 9:
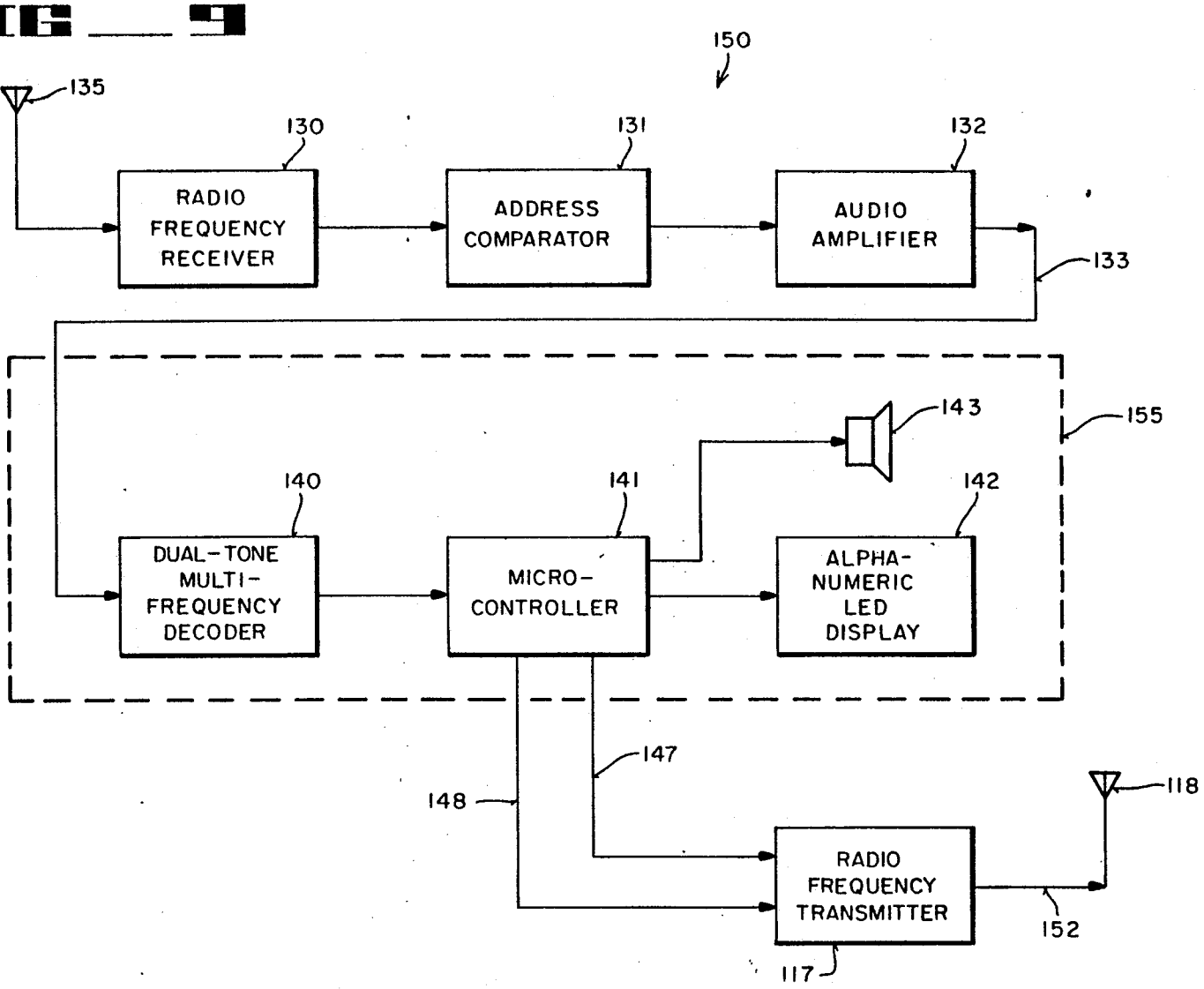
FIG. 9 is a block diagram of additional details of circuitry resident on a game ticket with a transmitter.
Figure 10:
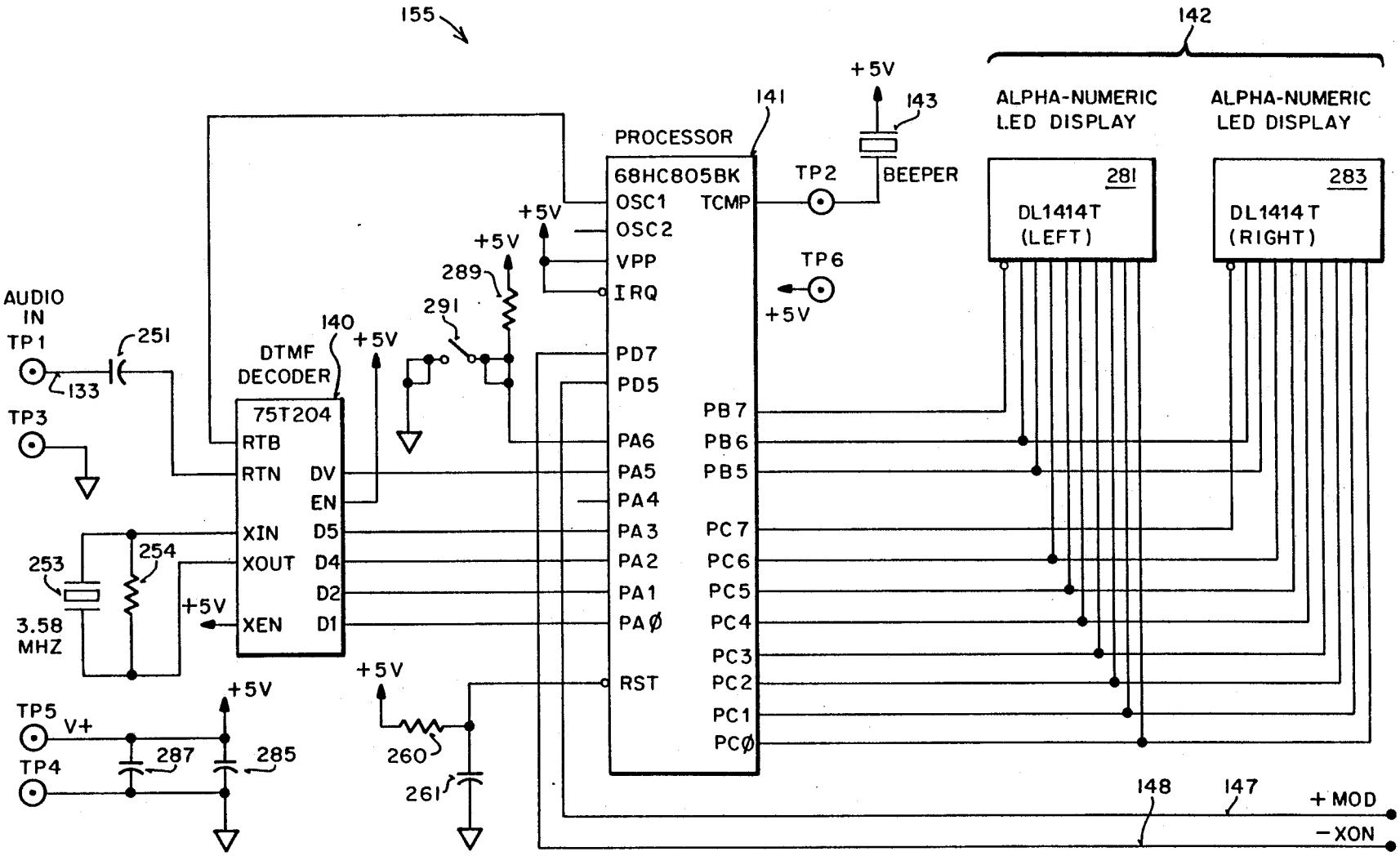
FIG. 10 is a schematic diagram showing additional details of circuitry for processing a signal received by circuitry resident on the game ticket with a transmitter.

In an alternative embodiment, the game value to be stored in memory 115 of FIG. 7 is generated by a microcontroller chip within ticket 110 through the use of a computer program. A microcontroller chip 141 is shown in FIGS. 9 and 10. This program uses a pseudo-random algorithm in order to generate a pseudo-random game value upon execution. That pseudo-random game value is then stored in memory 115 of FIG. 7.

In one alternative embodiment, each pseudo-random number generated is associated with a particular drawing of the game. A win occurs when the internally-generally pseudo-random number is a winning value for the particular drawing of the game. The numbers generated within ticket 110 as part of a sequence of pseudo-random numbers are seemingly random, but in fact the entire sequence of such seemingly random numbers is generated in an entirely deterministic way by the mathematical algorithm involved.

In one alternative embodiment, the sequence of pseudo-random numbers originates from a single "seed" number. That random number seed is first assigned to ticket 110 by the sponsor of the game or lottery. The sponsor of the game keeps a record of the fact that a particular seed number has been assigned to a particular ticket 110. This allows the sponsor of the game to precisely verify that a particular ticket 110 has in fact won the particular game on a particular drawing.

For example, suppose that upon the 100th drawing of a game a particular ticket 110 sends out a signal indicating that the ticket is a winning ticket. The holder of ticket 110 would present the ticket to the sponsor of the game. The sponsor of the game would have a record of the random number seed for that particular ticket 110. The sponsor would also know the mathematical algorithm used to generate to sequence of pseudo-random numbers for ticket 110. The sponsor of the game could therefore calculate what pseudo-random number should have been generated within the particular ticket 110 upon the 100th drawing of the game. In this way, the sponsor can verify that the particular ticket 110 in fact is the winning ticket for the 100th drawing of the game.

Figure 8:
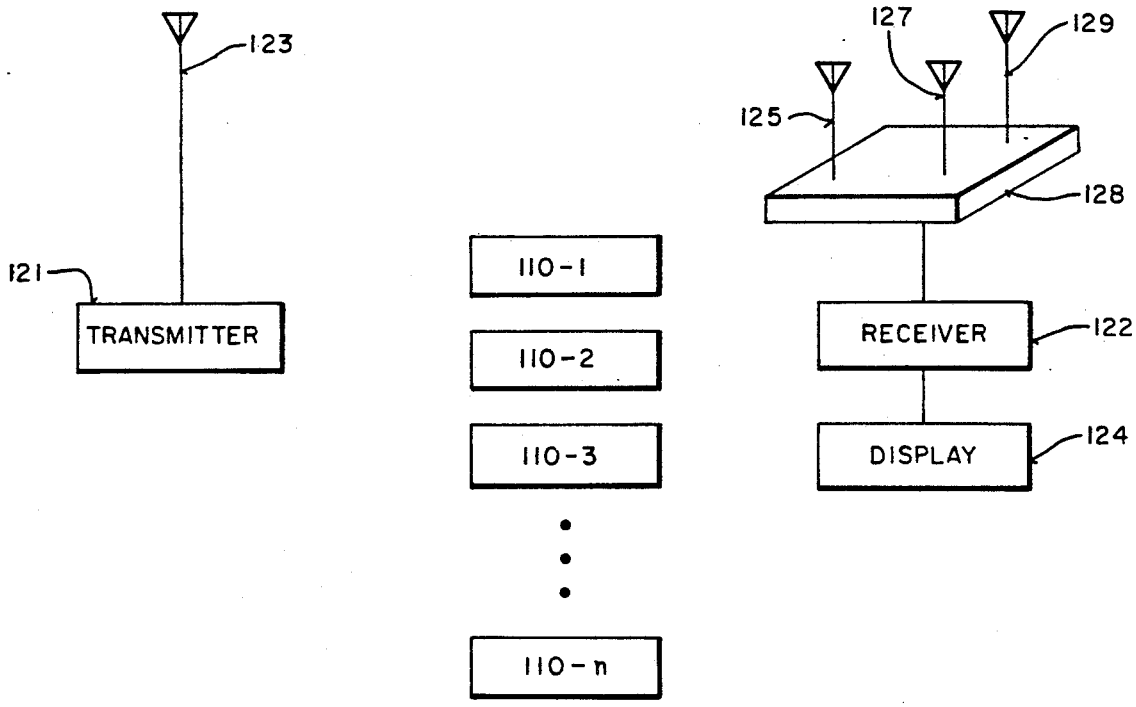
FIG. 8 is a block diagram showing a transmitter, a receiver, antennas, a display, and a plurality of electrical game tickets.

FIG. 8 illustrates one embodiment that employs a plurality of tickets 110-1 through **110-*n*. At a designated time, transmitter 121 and transmitting antenna 123 are used to broadcast a message containing a code or value. Transmitter 121 can be a simple hand-held device for short range operation, such as in a casino or other confined physical area. Alternatively, transmitter 121 can be a higher power unit requiring a sizable transmitting facility for long range operation. Such long range operation might cover a city or a state. In one embodiment, transmitter 121** is under the control of the sponsor of the lottery.

The value broadcast could result in one of the tickets 110-1 through **110-*n* being a winning ticket if the value stored in that ticket is a winning value according to the rules of the game. Receiving means 111 in each ticket 110** receives the transmitted message and recovers the transmitted code for processing. In one embodiment, an unsecured message is broadcast. In alternative embodiments, various security devices or techniques are used to provide a secure transmission and a secure reception of the broadcast message.

A comparator 114 in each of the tickets 110-1 through **110-*n* compares the broadcast code received to the stored code in memory 115 and ascertains whether the stored code is a winning value in view of the rules of the game. If one of the tickets 110-1 through 110-*n* is a winning ticket, then the transmitter means 116 of that winning ticket transmits or broadcasts a radio frequency signal that indicates that the particular ticket has found a match. For example, if ticket 110-2 is a winning ticket, then the transmitter means 116 of ticket 110-2 transmits a signal indicating that ticket 110-2 is a winning ticket. In addition, in one embodiment indicator means 119 on ticket 110-2 displays both a visual and an audio message to the holder of ticket 110-2 to indicate that ticket 110-2** is a winning ticket.

Receiver 122, and antennas 125, 127, and 129, and display unit 124 are then used to locate the winning ticket, which in this case, is ticket 110-2. Receiver 122, antennas 125, 127, and 129, and display unit 124 are part of a beacon tracking system, also referred to as a locater system. In one embodiment, receiver 122, display 124, and antennas 125, 127, and 129 are of the type described in U.S. Pat. Nos. 4,001,828, 4,021,807, and 4,023,176. In one embodiment, the sponsor of the lottery operates the beacon tracking system.

Antennas 125, 127, and 129 are three radio frequency antennas that reside on block or plane 128. Antennas 125, 127, and 129 are selected to be efficient receivers at the frequency transmitted by the winning ticket of tickets 110-1 through **110-*n*. In one embodiment, antennas 125, 127, and 129 are attached to a mobile unit, such as a van. Antennas 125 and 127 are located along a line that is perpendicular to the direction of travel of the van. Antennas 127 and 129 are located along a line that is parallel to the direction of travel of the van. The separation between antennas 125 and 127 and between antennas 127 and 129 is approximately one-half wave length at the frequency transmitted by the winning ticket of electrical tickets 110-1 through 110-*n*. Receiver 122 and display unit 124** would be in the van.

When the transmitting ticket 110-2 is directly in front of or behind the van, the electrical signals received by antennas 125 and 127 will be in phase. If, however, the van is oriented such that the transmitting electrical ticket 110-2 is located to the left of the van's fore/aft axis, then the phase of the signal received by antenna 125 will lag that of the signal received by antenna 127. In a similar manner, the signals received by antennas 127 and 129 will be in phase when the transmitting electrical ticket 110-2 is directly abreast of the van, but will be out of phase at those times when the transmitting electrical ticket is either ahead of or behind the lateral axis of the van. The signals received by the three antennas 125, 127, and 129 are processed in beacon tracking receiver 122 so as to provide, through display unit 124, a visual and audible indication of the relative direction of the winning electrical ticket 110.

The sponsor of the lottery uses the beacon locater means to determine the physical location of a ticket 110 for which a match has occurred. Once the sponsor of the lottery has, for example, located ticket 110-2 for which a match has occurred, the sponsor could notify the holder of that winning ticket 110-2 that he or she has won the lottery. The driver of the van used in locating the winning ticket could pay out the prize to the holder of winning ticket 110-2. The van could be equipped with a television camera so that the paying out of the prize to the holder of the winning ticket 110 could be televised. The state lottery could notify newspapers and television stations that the lottery has been won and could give the newpapers and television stations the location of the winning ticket 110-2.

In an alternative embodiment, other locater means could be used in place of receiver 122, display unit 124, and antennas 125, 127, and 129.

In one embodiment, the frequency of the signal broadcast by transmitter 121 and antenna 123 is different from the frequency transmitted by the transmission means of the winning ticket. In an alternative embodiment, the frequency of the signal broadcast by transmitter 121 and antenna 123 is substantially the same as the frequency transmitted by the transmission means of the winning ticket.

It is to be appreciated that, depending upon the particular game, there could be one winning ticket, multiple winning tickets, or no winning tickets for that game.

FIG. 9 illustrates ticket 150 that is capable of receiving a broadcast message and capable of transmitting a signal that indicates that ticket 150 is a winning ticket for a lottery game. Ticket 150 could be substituted for each of the plurality of tickets 110-1 through **110-*n* of FIG. 8. In one embodiment, electrical ticket 150 employs the same transmitter 117 and antenna 118 as ticket 110. In alternative embodiments, other transmitter circuitry could be used in place of transmitter 117 of tickets 110 and 150**.

Electrical ticket 150 of FIG. 9 includes antenna 135, radio frequency receiver 130, address comparator 131, audio amplifier 132, lines 133, dual-tone multifrequency decoder 140, microcontroller 141, speaker 143, alphanumeric LED display 142, lines 147 and 148, radio frequency transmitter 117, line 152, and antenna 118. Circuitry 155 of ticket 150 is comprised of dual-tone multifrequency decoder 140, microcontroller 141, beeper 143, and alphanumeric LED display 142.

Radio frequency receiver 130 is coupled to antenna 135. Radio frequency receiver 130 receives a broadcast message via antenna 135. In one embodiment, radio frequency receiver comprises the electrical components of a known radio pager that provides a voice quality audio output. In one embodiment, radio frequency receiver 130 receives dual-tone multifrequency signals that are in turn provided as an audio output from radio frequency receiver 130. In alternative embodiments, other prior art coded signals could be used in lieu of DTMF signals.

For the embodiment shown in FIG. 9, radio frequency receiver 130 receives the message broadcast by the Motorola BPR 2000 regional network. Part of the broadcast message is an address code that is used to identify the broadcast message as one appropriate for the particular game and electrical ticket. The address that appears as part of the broadcast message is compared to the address stored in address comparator 131. If the addresses agree, the broadcast message received is then passed on to audio amplifier 132, which is coupled to address comparator 131. Audio amplifier 132 amplifies the signal received from address comparator 131.

The output signal from audio amplifier 132 passes to dual-tone multifrequency decoder 140 via lines 133. Decoder 140 decodes the DTMF signals present in the broadcast message. Microcontroller 141 is coupled to dual-tone multifrequency decoder 140, and decoder 140 provides a 4-bit signal (representing up to 16 different possibilities) to microcontroller 141. Decoder 140 continues to send 4-bit signals to microcontroller 141 until a complete message comprising a sequence of such 4-bit signals is accumulated at microcontroller 141. For example, the entire message (excluding the address code) can be comprised of 22 such 4-bit signals.

In an alternative embodiment wherein coded signals other than DTMF signals are used, ticket 150 would include a decoder to decode such signals.

In the embodiment shown in FIG. 9, microcontroller 141 includes software routines that provide the necessary programming for and oversee the operation of ticket 150.

In the embodiment shown in FIG. 9, microcontroller 141 contains the stored value for the player possessing ticket 150. That stored value for ticket 150 can be stored in the memory of microcontroller 141 either before ticket 150 is purchased, at the time ticket 150 is purchased, or after ticket 150 is purchased. Microcontroller 141 determines if the stored value of ticket 150 is a winning value for the particular game being played, given the message received. This determination is based on the particular rules and prize structure of the particular game being played.

If the stored value of ticket 150 is a winning value for the particular game being played, then microcontroller 141 causes an audio alarm 143, such as a beeper, to emit an audible sensory indication to the player. In addition, microcontroller 141 causes alphanumeric LED display 142 to display an alphanumeric message to the holder of ticket 150, such as "Win $200." In alternative embodiments, other audio and visual indications could be used to show that ticket 150 is a winning ticket. In one alternative embodiment, a vibrator is used to provide a vibrational indication that shows that ticket 150 is a winning ticket.

If the stored value for ticket 150 is not a winning value for the particular game being played, then microcontroller 141 does not activate beeper 143. For that situation microcontroller 141 can, however, display the nine digit winning value on LED 142.

If the stored value for ticket 150 is a winning value for the particular game being played, then microcontroller 141 also sends a signal via lines 147 and 148 to radio frequency transmitter 117. Upon receiving such signals, radio frequency transmitter 117 in turn transmits a signal to antenna 118 via line 152. The signal is broadcast by antenna 118. The signal broadcast indicates that ticket 150 is a winning ticket for the game being played. As described previously with respect to FIGS. 7 and 8, a beacon tracking system or locater means is then used to determine the geographical location of the winning ticket 150 that is broadcasting a signal.

Ticket 150 is powered by batteries supplying a total of 6 volts. Voltage dividers provide the 1.5 volt power required by units 130, 131, and 132. Voltage dividers also provide the 5.0 volt power required by units 140, 141, 142, 143, and 117.

FIG. 10 illustrates circuitry that comprises circuitry 155 of electrical ticket 150. DTMF decoder 140 is a 75T204-IL chip sold by Silicon Systems of Tustin, Calif. DTMF decoder chip 140 converts the 16 standard DTMF touch tones generated by a touch-tone telephone into a 4-bit hexadecimal code. An audio input signal on line 133 coming from audio amplifier 132 (of FIG. 9) is coupled through a capacitor 251 to pin XIN of decoder chip 140. Capacitor 251 of FIG. 10 is a 0.01 microfarad 50 volt capacitor. A 3.579545 Megahertz color-burst crystal 253 and a 1 megaohm resistor 254 are coupled in parallel between pins XIN and XOUT of DTMF decoder chip 140.

Microcontroller 141 comprises an 8-bit microcontroller unit MC68HC805BK integrated circuit chip sold by Motorola Semiconductor Products of Phoenix Ariz. Microcontroller chip 141 is packaged in a 28 lead SOJ (surface mount) package. Microcontroller chip 141 uses the block output of decoder chip 140 as a time base. Microcontroller chip 141 contains 2K bytes of PROM implemented as an EEPROM memory, 128 bytes of scratchpad RAM, and 21 I/O lines. Microcontroller chip 141 is also referred to as processor 141.

The EN pin of DTMF decoder 140 is held to the +5 volt level in order to enable DTMF decoder 140. The DV pin of DTMF decoder 140 indicates the presence of a valid single touch-tone signal. Each such signal is one of 16 possibilities (hexadecimal). The D1, D2, D3, and D4 pins of DTMF decoder 140 provide a 4-bit signal representing a single touch-tone tone to microcontroller chip 141.

Microcontroller 141 assembles the single hexadecimal touch-tone signals into a complete message. This message is comprised of a designated special starting symbol and a designated special ending symbol, as described. This message contains a field that indicates the specific game involved and additional fields containing the broadcast values for the game.

The memory of microcontroller 141 contains the stored value for ticket 150 for the specific game being played. That stored value for ticket 150 can be stored in the memory of microcontroller 141 either before ticket 150 is purchased, at the time ticket 150 is purchased, or after ticket 150 is purchased. Controller chip 141 determines whether the stored value in the memory of microcontroller chip 141 is a winning value for the particular game being played, given the broadcast values.

The functionality of microcontroller chip 141 derives from its internal program. This program resides in the EEPROM of microcontroller chip 141 and is inserted into that EEPROM using a Motorola Development System M68HC05EVM and a computer terminal.

Beeper 143 is coupled between the TCMP pin of microcontroller 141 and the 5 volt power supply. Beeper 143 is a piezoelectric transducer. Piezoelectric transducer 143 produces an audible sensory indication of a winning match upon the command of microcontroller 141. The tone frequency of beeper 143 is determined by software in microcontroller 141.

Circuitry 155 also includes switch 291 coupled to pin PA6 of microcontroller 141. Switch 291 is also coupled to resistor 289, which is a 10 kilohm resistor. Resistor 289 is in turn coupled to the 5 volt power supply. The ATB pin of decoder 140 is coupled to the OSC1 pin of microcontroller 141. The RST pin of microcontroller 141 is coupled to capacitor 261, which is in turn coupled to ground. Capacitor 261 is a 1.5 microfarad 10 volt capacitor. The RST pin of microcontroller 141 is also coupled to resistor 260, which is in turn coupled to the 5 volt power supply. Resistor 260 is a 10 kilohm resistor.

Capacitors 285 and 287 are coupled in parallel between pins TP5 and TP4 of circuitry 155. Capacitor 285 is a 0.1 microfarad 50 volt capacitor. Capacitor 287 is a 10 microfarad 10 volt capacitor.

Pin TP6 is coupled to the 5 volt power supply. Pin TP3 is coupled to ground.

Alphanumeric LED display 142 is comprised of devices 281 and 283. Devices 281 and 283 are LED character display devices. LEDs 281 and 283 are each a DL1414T LED sold by Siemens Components of Cupertino, Calif. LED devices 281 and 283 each contain onboard ASCII decoders and segment drivers.

Figure 11:
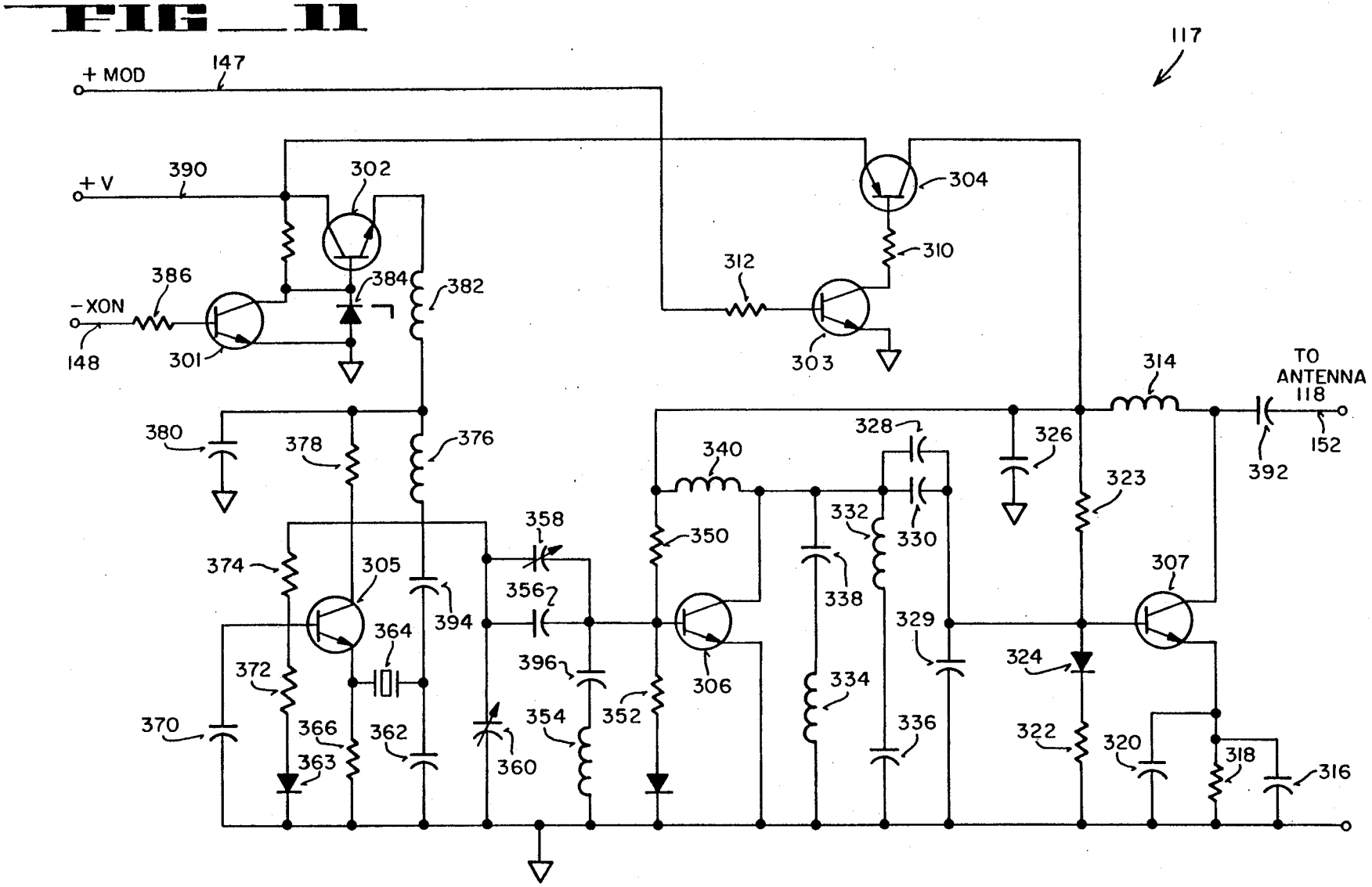
FIG. 11 is a schematic diagram of a transmitter resident on the game ticket.

Pins PD5 and PD7 of microcontroller 141 are the control outputs for transmitter circuit 117 shown in FIGS. 9 and 11. As shown in FIG. 10, pin PD5 is coupled to line 147 and carries the +MOD signal. Pin PD7 is coupled to line 148 and carries the −XON signal.

FIG. 11 illustrates a schematic diagram of radio frequency transmitter 117. A transmitter having circuitry similar to much of the circuitry shown in FIG. 11 is disclosed in each of U.S. Pat. Nos. 4,021,807, 4,001,828, and 4,023,176.

In an alternative embodiment, other transmitter circuitry could be used in place of the circuitry shown in FIG. 11.

Radio frequency transmitter 117 of FIG. 11 transmits a 347 Megahertz signal upon the command of microcontroller 141. Transmitter 117 includes transistors 301, 302, 303, 304, 305, 306, and 307. A 5 volt signal, the +MOD signal, and the −XON signal are applied as inputs to the circuitry of radio frequency transmitter 117. An output from transmitter 117 is coupled via line 152 to antenna 118.

The +MOD signal is coupled to the base of NPN transistor 303 via resistor 312 and line 147. A 5 volt signal is coupled to the collector of transistor 302 via lines 390. A −XON signal is coupled to the base of transistor 301 via line 148 and resistor 386. Antenna 118 is coupled to the collector of transistor 307 via capacitor 392.

Transistor 301 is controlled by the −XON signal on line 148 from microcontroller 141. Signal −XON from microcontroller 141 turns the power on and off for transmitter 117 via transistor 301. If microcontroller 141 provides a low voltage at pin PD7, then the −XON signal is low, and this in turns on transmitter 117.

Transistor 305; resistors 378, 374, 372, and 366; capacitors 370, 362, 380, and 394; diode 363; inductor 376; piezoelectric crystal 364; and variable capacitor 360 comprise a radio frequency oscillator tuned to 115.667 Megahertz. NPN transistor 302 provides a regulated voltage to the oscillator stage based on transistor 305 of transmitter 117.

The output of transistor 305 is coupled to transistor 306. Transistor 306; capacitors 396, 338, and 336; inductors 354, 340, 334, and 332; and resistors 350 and 352 triple the frequency of oscillation to 347 Megahertz. Inductor 332 and capacitors 328, 329, 330, and 336 provide filtering.

The signal with this 347 Megahertz frequency is applied to transistor 307, which forms part of a radio frequency amplifier. The amplified signal is in turn applied to antenna 118 via capacitor 392. The components are selected to apply 100 to 150 milliwatts to antenna 118. Resistor 318 and capacitors 316 and 320 are coupled to the emitter of transistor 307. Resistor 323 and diode 324 are coupled to the base of transistor 307. Resistor 322 is in turn coupled to diode 324. Inductor 314 is coupled to the collector of transistor 307. Capacitor 326 is coupled to inductor 314.

Transistors 303 and 304 modulate the antenna output at 570 Hertz. This aids the receiver 122 of FIG. 8 in the rejection of spurious signals. The input modulation to transistor 303 of FIG. 11 is derived from microcontroller 141 pin PD5 and is generated by the software in microcontroller 141. The signal generated at pin PD5 is the +MOD signal applied to the base of transistor 303 via line 147 and resistor 312. Resistor 310 is coupled between transistor 303 and transistor 304.

In the foregoing specification, the invention has been described with reference to specific exemplary embodiments therof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A portable electrical ticket apparatus for a game, comprising:

a radio frequency receiver for receiving a broadcast of a dual-tone multifrequency signal containing a winning variable for the game, wherein the broadcast signal is broadcast over a transmission medium;

a dual-tone multifrequency decoder for decoding the broadcast signal received into a multibit decoded signal;

storage means for storing a first variable;

a central processing unit coupled to the decoder and to the storage means for ascertaining whether the first variable stored in the storage means is the winning variable in view of the multibit decoded signal;

a radio frequency transmitter responsive to the central processing unit for transmitting over the transmission medium a signal that indicates that the first variable is the winning variable if the first variable is the winning variable.

2. The portable electrical ticket apparatus of claim 1, wherein the winning variable is a winning number and the first variable is a first number.

3. The portable electrical ticket apparatus of claim 1, further comprising means for generating the first variable.

4. The portable electrical ticket apparatus of claim 3, wherein the means for generating the first variable comprises a pseudo-random generator.

5. The portable electrical ticket apparatus of claim 1, further comprising an address comparator for comparing the broadcast signal to an address stored within the portable electrical ticket apparatus in order to determine whether the broadcast signal is appropriate for the game.

6. The portable electrical ticket apparatus of claim 1, wherein the central processing unit and the storage means are included within a microcontroller.

7. The portable electrical ticket apparatus of claim 1, further comprising indicator means responsive to the central processing unit for providing an indication that the first variable is the winning variable if the first variable is the winning variable.

8. The portable electrical ticket apparatus of claim 7, wherein the indicator means includes a visual indicator for providing a visual indication.

9. The portable electrical ticket apparatus of claim 8, wherein the visual indicator is an alphanumeric display.

10. The portable electrical ticket apparatus of claim 7, wherein the indicator means includes a sound generation device for providing an audio indication.

11. The portable electrical ticket apparatus of claim 1, wherein the indicator means comprises a vibrator for providing a vibrational indication.

12. The portable electrical ticket apparatus of claim 1, further comprising means for rendering the portable electrical ticket apparatus inoperable if there is an unauthorized alteration of the first variable.

13. A ticket system for a game, comprising:

(a) a transmitter for broadcasting a signal containing a winning variable for the game over a transmission medium;

(b) a portable electrical ticket apparatus comprising:

(1) a radio frequency receiver for receiving a broadcast of the signal containing the winning variable for the game;

(2) storage means for storing a first variable;

(3) a central processing unit coupled to the receiver and to the storage means for ascertaining whether the first variable stored in the storage means is the winning variable in view of the received broadcast;

(4) a transmitter responsive to the central processing unit for transmitting over the transmission medium a signal that indicates that the first variable is the winning variable if the first variable is the winning variable;

(5) locater means for locating the portable electrical ticket apparatus based on reception of the signal transmitted by the electrical ticket apparatus if the first variable is the winning variable.

14. The ticket system of claim 13, wherein the winning variable is a winning number and the first variable is a first number.

15. The ticket system of claim 13, further comprising impregnating means for impregnating the storage means with the first variable.

16. The ticket system of claim 13, further comprising means for generating the first variable.

17. The ticket system of claim 16, wherein the means for generating the first variable comprises a pseudo-random generator.

18. The ticket system of claim 13, wherein the portable electrical ticket apparatus further comprises means for generating the first variable.

19. The ticket system of claim 18, wherein the means for generating the first variable comprises a pseudo-random generator.

20. The ticket system of claim 13, wherein the portable electrical ticket apparatus further comprises an address comparator for comparing the broadcast signal to an address stored within the portable electrical ticket apparatus in order to determine whether the broadcast signal is appropriate for the game.

21. The ticket system of claim 13, wherein the central processing unit and the storage means are included within a microcontroller.

22. The ticket system of claim 13, wherein the portable electrical ticket apparatus further comprises indicator means responsive to the central processing unit for providing an indication that the first variable is the winning variable if the first variable is the winning variable.

23. The ticket system of claim 22, wherein the indicator means includes a visual indicator for providing a visual indication.

24. The ticket system of claim 23, wherein the visual indicator is an alphanumeric display.

25. The ticket system of claim 22, wherein the indicator means includes a sound generation device for providing an audio indication.

26. The ticket system of claim 22, wherein the indicator means comprises a vibrator for providing a vibrational indication.

27. A method of playing a game, comprising the steps of:

generating a first variable;

storing an electrical representation of the generated first variable in storage means within a portable electrical ticket apparatus;

broadcasting by radio frequency transmission a signal containing an electrical representation of a winning variable for the game;

receiving within the portable electrical ticket apparatus the radio frequency transmission of the broadcast signal containing the electrical representation of the winning variable;

comparing within the portable electrical ticket apparatus the stored electrical representation of the generated first variable with the electrical representation of the winning variable;

transmitting with a transmitter of the portable electrical ticket apparatus a radio frequency signal that indicates that the first variable is the winning variable if the first variable is the winning variable;

locating the portable electrical ticket apparatus based on reception by locater means of the radio frequency signal transmitted by the portable electrical ticket apparatus.

28. The method of claim 27 of playing a game, further comprising the step of providing an indication emanating from the portable electrical ticket apparatus that the generated first variable is the same as the winning variable if the generated first variable is the same as the first variable.

29. The method of claim 27 of playing a game, wherein the step of generating a first variable comprises having a player of the game select a first variable.

30. The method of claim 27 of playing a game, further comprising the step of comparing within the portable electrical ticket apparatus the broadcast signal to an address stored within the portable electrical ticket apparatus in order to determine whether the broadcast signal is appropriate for the game.

31. The method of claim 27 of playing a game, wherein the indication emanating from the portable electrical ticket apparatus is a visual indication.

32. The method of claim 27 of playing a game, wherein the indication emanating from the portable electrical ticket apparatus is an audio indication.

33. The method of claim 27 of playing a game, wherein the indication emanating from the portable electrical ticket apparatus is a vibrational indication.

* * * * *